United States Patent [19]

Kuwahata et al.

[11] Patent Number: 4,608,514

[45] Date of Patent: Aug. 26, 1986

[54] PHOTOCONDUCTIVE TARGET OF THE IMAGE PICKUP TUBE

[75] Inventors: Takao Kuwahata, Tokyo; Sohei Manabe; Katsuhiro Gonpei, both of Yokohama, all of Japan

[73] Assignee: Kabushiki Kaisha Toshiba, Kawasaki, Japan

[21] Appl. No.: 726,316

[22] Filed: Apr. 23, 1985

[30] Foreign Application Priority Data

Apr. 25, 1984 [JP] Japan ..... 59-81984

[51] Int. Cl.[4] ..... H01J 31/38

[52] U.S. Cl. ..... 313/386; 313/366

[58] Field of Search ..... 313/384, 385, 386, 366

[56] References Cited

U.S. PATENT DOCUMENTS

| | | | |
|---|---|---|---|
| 4,119,994 | 10/1978 | Jain et al. | 357/16 |
| 4,255,686 | 3/1981 | Maruyama et al. | 313/366 |
| 4,405,879 | 9/1983 | Ataka et al. | 313/386 |
| 4,488,083 | 12/1984 | Inoue et al. | 313/386 X |
| 4,556,816 | 12/1985 | Imamura et al. | 313/386 X |

FOREIGN PATENT DOCUMENTS

| | | |
|---|---|---|
| 0036779 | 9/1981 | European Pat. Off. . |
| 2808802 | 9/1978 | Fed. Rep. of Germany . |
| 45-6176 | 3/1970 | Japan . |
| 45-36058 | 11/1970 | Japan . |
| 51-18155 | 6/1976 | Japan . |
| 57-208041 | 12/1982 | Japan . |

*Primary Examiner*—Stewart J. Levy
*Assistant Examiner*—Joseph W. Roskos
*Attorney, Agent, or Firm*—Cushman, Darby and Cushman

[57] ABSTRACT

Disclosed is a photoconductive target of an image pickup tube having a transparent substrate, a transparent conductive layer formed on the transparent substrate, a photoconductive layer formed on the transparent conductive layer and containing cadmium, tellurium and selenium as major components, and a high resistance layer formed on the photoconductive layer. The film thickness of the photoconductive layer is more than 1,000 Å and less than 10,000 Å and the film thickness of the high resistance layer falls within the range between 2 and 10 μm.

10 Claims, 6 Drawing Figures

PHOTOCONDUCTIVE TARGET OF THE IMAGE PICKUP TUBE

BACKGROUND OF THE INVENTION

I. Field of the Invention

The present invention relates to a photoconductive target of a vidicon type image pickup tube and, more particularly, to an improvement in a photoconductive target which has a high transference sensitivity in a visible light range and a good after image characteristic.

II. Description of the Prior Art

As materials of a photoconductive target of a vidicon type image pickup tube, $Sb_2S_3$, PbO, Si, Se-Te-As, ZnSe-ZnCdTe, CdSe-$CdSeO_3$-$As_2Se3$ and the like are known. Among these materials, a photoconductive target containing PbO or Se-Te-As as a major component has a relatively low sensitivity but a low dark current and short response time. For this reason, such a photoconductive target is used for forming color images. Although a target using a ZnSe-ZnCdTe or CdSe material has a quantum efficiency which is substantially 1 unity and has a poor after image characteristic, i.e., relatively long response time as compared to the PbO target described above, it has a high sensitivity about 10 times that of the PbO target.

The present inventors have proposed a photoconductive target having a low dark current characteristic and a high sensitivity not only in a visible light region but also in an infrared light region. In this photoconductive target, a photoconductive layer is formed of a material represented by the general formula $CdTe_{(1-x)}Se_{(x)}$ (where (x) is 0.3 to 0.5) so as to be considerably thick, e.g., 1.5 μm. A target layer comprising a high resistance $As_2Se3$-system amorphous semiconductor layer formed on the photoconductive layer to be relatively thin, e.g., 1.5 μm. Although the target has high sensitivity up to an infrared light region as described above, the after image characteristic is not as good as that obtained with the PbO film.

SUMMARY OF THE INVENTION

The present invention has been made in order to resolve the above problem, and has as its object to provide a photoconductive target having a good after image characteristic, i.e., a short response time while maintaining a satisfactory photosensitivity and dark current characteristic in a visible light range.

According to the present invention, the photoconductive target comprises a transparent substrate, a transparent conductive layer formed thereon, a photoconductive layer containing cadmium, tellurium and selenium as major components and formed on the conductive layer, and a high resistance layer formed on the photoconductive layer. A film thickness of the photoconductive layer is more than 1,000 Å and less than 10,000 Å, preferably, 2,000 to 8,000 Å, and a film thickness of the high resistance layer is 2 to 10 μm, preferably 3 to 6 μm.

The photoconductive layer may be essentially formed on a material expressed by the general formula $CdTe_{1-x}Se_x$ (where x is 0.3 to 0.9). Variable x is preferably 0.4 to 0.7.

The high resistance layer may be formed of an amorphous semiconductor containing As and Se as major components.

DETAILED DESCRIPTION OF THE PREFERRED EMBODIMENT

Figure 1:
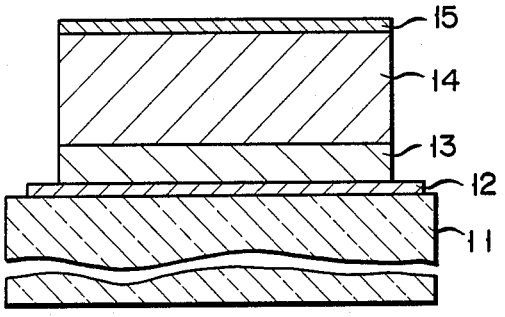
FIG. 1 is a sectional view of a photoconductive target of an image pickup tube according to an embodiment of the present invention.

An embodiment of the present invention will be described with reference to the accompanying drawings. As shown in FIG. 1, in a photoconductive target according to the present invention, a transparent conductive layer 12 such as a NESA film is deposited on a transparent substrate 11 such as a glass faceplate directly or through another transparent layer such as a color filter film. A photoconductive layer 13 is formed on the layer 12 to a thickness of more than 1,000 Å and less than 10,000 Å, e.g., 5,000 Å. A high resistance layer 14 of an As-Se-system amorphous semiconductor is deposited on the layer 13, and an $Sb_2S_3$ film 15 is deposited thereon to a thickness of about 1,000 Å. A thickness of the high resistance layer 14 falls within the range between 2 μm and 10 μm.

In this target, the photoconductive layer 14 having a photoelectric conversion function has a composition expressed by the general formula $CdTe_{(1-x)}Se_{(x)}$, where x is set to fall within the range between 0.3 to 0.9. That is, in $CdTe_{(1-x)}Se_{(x)}$, Te:Cd is 0.7 to 0.1:1, and Se:Cd is 0.3 to 0.9:1. For example, (x) is selected to be 0.4.

A preferred method of manufacturing the photoconductive target described above will be described hereinafter.

The transparent conductive layer 12 is deposited on the transparent substrate 11. CdTe and CdSe are deposited on the conductive layer 12 in an argon gas atmosphere at a pressure of 0.01 to 1 Torr upon maintaining a substrate temperature of 100° C. to 400° C. In this deposition process, CdTe powder and CdSe powder are mixed at a predetermined molar ratio and the resultant mixture is thermally treated so as to form a solid solution. The solid solution can be placed in an evaporation crucible to be deposited. Alternatively, CdTe and CdSe are placed in different evaporation sources, or Cd, Te and Se are respectively placed in different evaporation sources, and can be simultaneously or alternately deposited so as to obtain the above-mentioned composition.

In this manner, the photoconductive layer 13 is formed to a thickness of, e.g., about 5,000 Å, and is sintered for 20 minutes in an inert gas atmosphere such as nitrogen ($N_2$) containing tellurium vapor at a temperature range between 500° C. and 700° C. The high resistance layer 14 of an As-Se-system amorphous semiconductor having a molar ratio of As to Se of, e.g., 0.1:0.9 is deposited on the sintered photoconductive layer 13 having a composition of $CdTe_{(1-x)}Se_{(x)}$ so as to be sufficiently thicker than the photoconductive layer 13, e.g., 0.4 μm. Then, the $Sb_2S_3$ layer 15 is formed on the layer 14 to a thickness of about 1,000 Å, thereby obtaining the photoconductive target comprising the above multilayer structure.

Characteristics of the photoconductive target of the image pickup tube obtained by this method will be described hereinafter.

The present inventors examined a so-called white light sensitivity, i.e., a signal current when an illuminance at a target surface illuminated by a standard light source with a light source temperature of 2,856K. was 1 lux. According to the target of the present invention, substantially the same sensitivity could be obtained as that of the conventional target (control target) previously proposed by the present inventors wherein the thickness of the photoconductive layer was large, i.e., about 1.5 μm and that of the high resistance layer of amorphous $As_2Se_3$ was small, i.e., about 1.5 μm.

Figure 2:
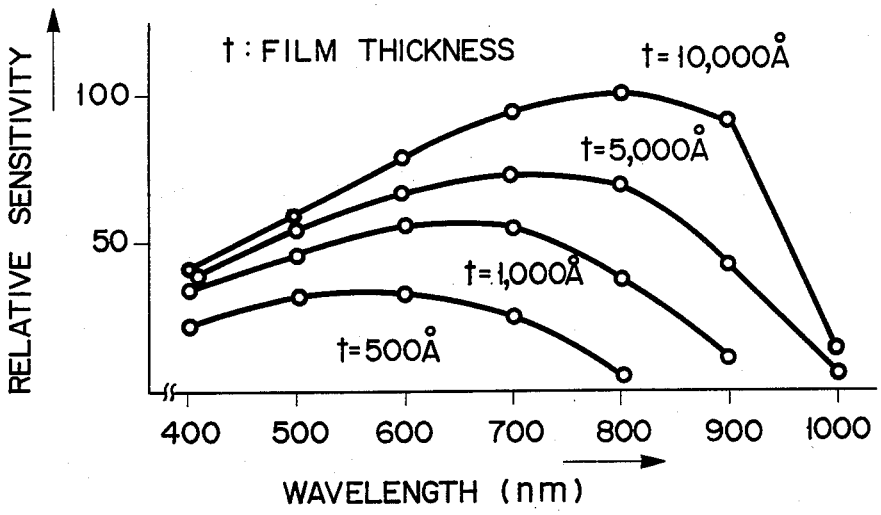
FIGS. 2 and 3 are graphs showing a change in the characteristics of the photoconductive target in accordance with a change in the thickness of a photoconductive layer.
Figure 3:
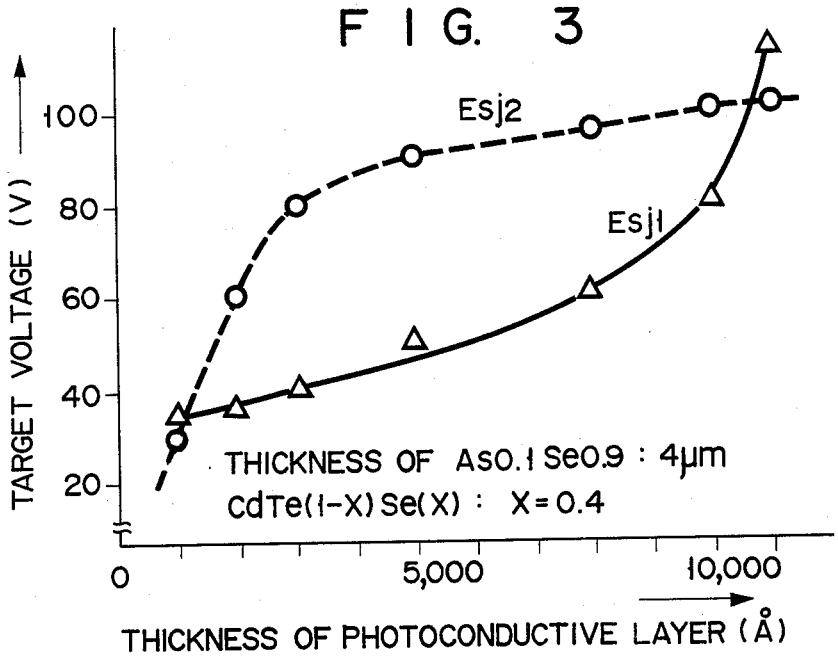

Meanwhile, a change in the photoelectric conversion sensitivity with respect to a change in film thickness of the photoconductive layer 13 was as follows. As shown in FIG. 2, it was found that in accordance with a decrease in film thickness t, the degradation in sensitivity was large in an infrared light region but was relatively small in a visible light region. Particularly in a short wavelength region, degradation in sensitivity was small with respect to a decrease in film thickness, and satisfactory characteristics could be obtained. However, when the photoconductive layer has a thickness of 1,000 Å or less, the sensitivity is considerably degraded in a blue region having a short wavelength.

At a target temperature of 25° C., a dark current characteristic was substantially the same as that of the control target (2 nA).

It was found that an after-image fading-out voltage (Esj1) and a screen damaging voltage (Esj2) were sufficiently low when the thickness of the photoconductive layer 13 fell within the range between 1,000 Å and 10,000 Å. That is, within this range, even though the target voltage slightly varies, image quality characteristics are not degraded, and satisfactory characteristics can be obtained.

The $CdTe_{(1-x)}Se_{(x)}$ layer is deposited on the transparent conductive layer in a vacuum or an inert gas atmosphere containing or not containing oxygen at a substrate temperature of 100° C. to 400° C., and thereafter is sintered at a temperature of 500° to 700° C., as described above. If sintering conditions are kept constant when the film thickness of the layer is increased, the sintering effect is insufficient. Specifically, this results in an increase in the after-image fading-out voltage, thereby increasing a dark current. Similarly, when (x) in the composition is increased and the sintering conditions are kept constant, the above effect also occurs. Conversely, when the film thickness is too thin or when (x) is 0.3 or less, i.e., the Te content is increased and sintering conditions are kept constant, a sintering effect is excessive. Therefore, the resistivity of the film is lowered, and the dark current is increased. Thus, the present inventors found that when (x) was large, if the film thickness was small, good characteristics could be obtained under constant sintering conditions. It was found that when (x) was, for example, 0.8, if the film thickness was 6,000 Å or less, satisfactory characteristics could be obtained.

It was confirmed that the photoconductive layer 13 represented good characteristics when it consisted mainly of crystal grains having an average particle size of 0.2 to 1 μm. When the sintering effect is insufficient, crystal growth is low, and the photoconductive layer consists mainly of crystal grains having a small particle size, resulting in poor sensitivity and high dark current. Conversely, when the sintering effect is excessive, good characteristics cannot be obtained. Therefore, the film thickness of the photoconductive layer must be more than 1,000 Å and less than 10,000 Å. A value of (x) preferably falls within the range between 0.3 and 0.9.

The relationship between the film thickness and characteristics of the high resistance layer 14 will be described below.

Figure 4:
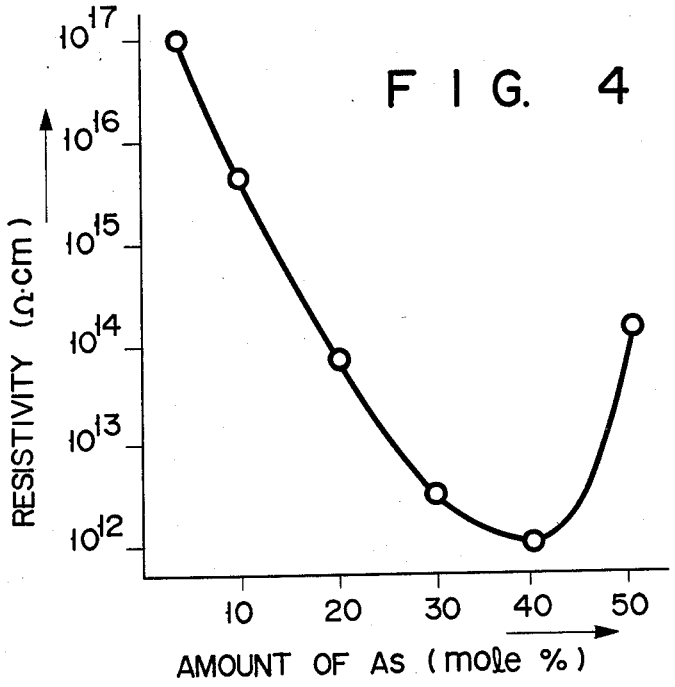
FIGS. 4 and 5 are respectively graphs showing changes in a resistivity and a dielectric constant of the high resistance layer in accordance with a change in the As content in the As-Se-system resistance layer.
Figure 5:
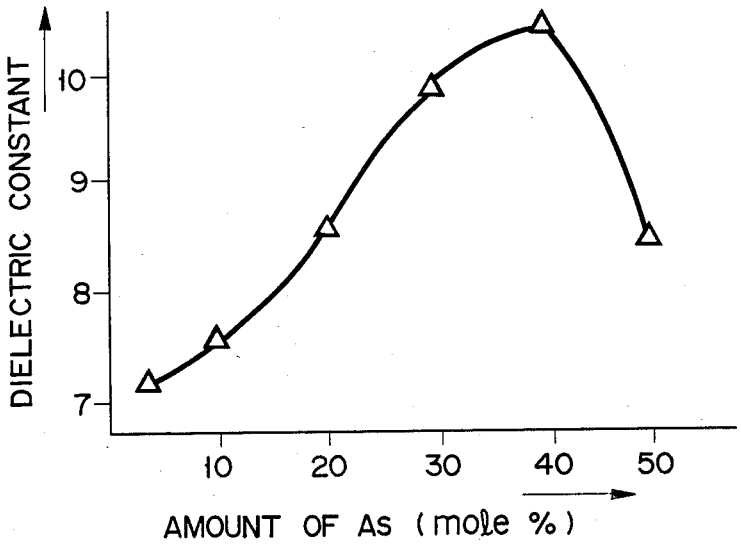

The high resistance layer 14 provides a charge accumulating function for controlling electrons flowing into the photoconductive layer 13. The dark resistivity of the layer 14 preferably falls within the range between $10^{12}$ Ωcm to $10^{17}$ Ωcm. The resistivity and the dielectric constant of the high resistance layer 14 of the As-Se-system amorphous semiconductor can be set in the proper range by controlling the As content, as shown in FIGS. 4 and 5. As can be seen from FIGS. 4 and 5, when the As content is set within the range between 3% and 40%, the resistivity can be set within the range between $10^{12}$ Ωcm and $10^{17}$ Ωcm, and the dielectric constant can be set within the range between 7.2 and 10.5, thus obtaining a satisfactory characteristic, as described above. When the As content exceeds 40%, the resistivity and the dielectric constant abruptly change and become unstable.

Figure 6:
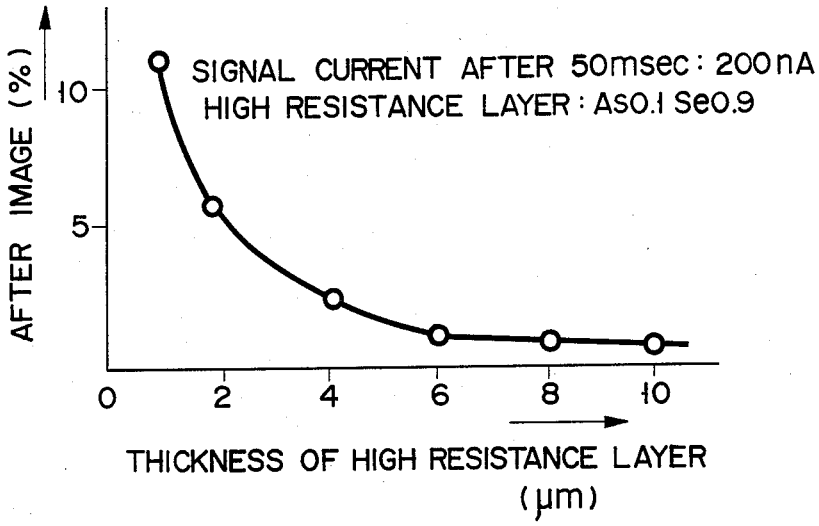
FIG. 6 is a graph showing a change in the characteristics of the photoconductive target in accordance with a change in the thickness of a high resistance layer.

When the film thickness of the photoconductive layer 13 is 5,000 Å and the high resistance layer 14 has a composition expressed by $As_{0.1}Se_{0.9}$, a change in the after image characteristic when the film thickness of the layer 14 is changed is shown in FIG. 6. As can be seen from FIG. 6, when the film thickness of the high resistance layer is about 2.0 μm or more, the after image characteristic can be maintained at 5% or less. An upper limit of the film thickness of the layer 14 is preferably set to be 10 μm so as not to excessively increase the target voltage. It should be noted that when an As concentration of the high resistance layer 14 is further decreased from 10%, the temperature at which an amorphous semiconductor is converted into a crystalline form is abruptly decreased. For example, when the As concentration is 1% or less, since the layer 14 is crystallized at about 90° C., its lower limit must be 3% with regard to a thermal environmental factor in a manufacturing step of an image pickup tube.

As described above, the photoconductive target of the image pickup tube according to the present invention can have a good after image characteristic, i.e., short response time while maintaining the photosensitivity and dark current characteristic at a satisfactory level.

What is claimed is:

1. A photoconductive target of an image pickup tube, comprising a transparent substrate, a transparent conductive layer formed on said transparent substrate, a photoconductive layer formed on said transparent conductive layer and containing cadmium, tellurium and selenium as major components, and a high resistance layer formed on said photoconductive layer, wherein the film thickness of said photoconductive layer is more than 1,000 Å and less than 10,000 Å and a film thickness of said high resistance layer falls within the range between 2 and 10 μm.

2. A photoconductive target according to claim 1, wherein the film thickness of said photoconductive layer falls within the range between 2,000 and 8,000 Å.

3. A photoconductive target according to claim 1, wherein the film thickness of said high resistance layer falls within the range between 3 and 6 μm.

4. A photoconductive target according to claim 1, wherein said photoconductive layer essentially consists of a material represented by a general formula $CdTe_{1-x}Se_x$ (where x is 0.3 to 0.9).

5. A photoconductive target according to claim 4, wherein the variable x falls within the range between 0.4 to 0.7.

6. A photoconductive target according to claim 4, wherei said photoconductive layer mainly consists of crystal grains having a particle size of 0.2 to 1 μm.

7. A photoconductive target according to claim 1, wherein said high resistance layer has a resistivity of $10^{12}$ to $10^{17}$ Ωcm.

8. A photoconductive target according to claim 1, wherein said high resistance layer is formed of an amorphous semiconductor containing arsenic and selenium as major components.

9. A photoconductive target according to claim 8, wherein the amorphous semiconductor essentially consists of an arsenic-selenium-system compound.

10. A photoconductive target according to claim 9, wherein the arsenic content in the amorphous semiconductor is 3 to 40 mole %.

* * * * *